US007157993B2

(12) United States Patent
DeNatale et al.

(10) Patent No.: US 7,157,993 B2
(45) Date of Patent: Jan. 2, 2007

(54) 1:N MEM SWITCH MODULE

(75) Inventors: Jeffrey F. DeNatale, Thousand Oaks, CA (US); Robert E. Mihailovich, Newbury Park, CA (US); Jonathan B. Hacker, Thousand Oaks, CA (US)

(73) Assignee: Rockwell Scientific Licensing, LLC, Thousand Oaks, CA (US)

( * ) Notice: Subject to any disclaimer, the term of this patent is extended or adjusted under 35 U.S.C. 154(b) by 0 days.

(21) Appl. No.: 10/676,875

(22) Filed: Sep. 30, 2003

(65) Prior Publication Data

US 2005/0068129 A1 Mar. 31, 2005

(51) Int. Cl.
*H01H 51/22* (2006.01)

(52) U.S. Cl. ..... 335/78; 200/181

(58) Field of Classification Search ..... 335/78; 200/181
See application file for complete search history.

(56) References Cited

U.S. PATENT DOCUMENTS

| | | | | |
|---|---|---|---|---|
| 4,516,091 | A | 5/1985 | Sasser | 333/161 |
| 5,578,976 | A | 11/1996 | Yao | 333/262 |
| 6,016,092 | A * | 1/2000 | Qiu et al. | 333/262 |
| 6,433,657 | B1 | 8/2002 | Chen | 333/262 |
| 6,440,767 | B1 * | 8/2002 | Loo et al. | 438/52 |
| 6,529,093 | B1 * | 3/2003 | Ma | 333/262 |
| 6,849,924 | B1 * | 2/2005 | Allison et al. | 257/635 |
| 6,888,420 | B1 * | 5/2005 | Schaffner et al. | 333/101 |
| 2003/0179058 | A1 * | 9/2003 | Vaitkus et al. | 335/78 |

FOREIGN PATENT DOCUMENTS

| | | |
|---|---|---|
| WO | WO 0209224 | 1/2002 |

OTHER PUBLICATIONS

A Surface Micromachined Miniature Switch for Telecommunications Applications With Signal Frequencies From DC up to 4 GHZ, Yao and Chang, In Tech. Digest, Transducer-95, Stockholm, Sweden, Jun. 25-29, 1995, pp. 384-387.

A DC-TO40 GHZ Four-Bit FR MEMS True-Time Delay Network, Hacker et al., IEEE Microwave and Wireless Components Lett., vol. 11, pp. 56-58, Feb. 2001.

Solid State Circuits/Control Circuits, The Electrical Engineering Handbook,1993, p. 1011-1013.

RF MEMS Theory, Design, and Technology, Gabriel M. Rebeiz, 2003, 9 MEMS Phase Shifters, p. 259-295.

* cited by examiner

*Primary Examiner*—Elvin Enad
*Assistant Examiner*—Bernard Rojas
(74) *Attorney, Agent, or Firm*—Koppel, Patrick & Heybl

(57) ABSTRACT

A 1:N MEM switch module comprises N MEM switches fabricated on a common substrate, each of which has input and output contacts and a movable contact which bridges the input and output contacts when the switch is actuated. The input contacts are connected to a common input node, and the output contacts are connected to respective output lines. Each output line has an associated inductance and effective capacitance, and is arranged such that its inductance is matched to its effective capacitance. The switches are preferably arranged symmetrically about the terminus point of the signal input line. A phase shifter employs at least two switch modules connected together with N transmission lines having different lengths, operated such that an input signal is routed via one of the transmission lines to effect a desired phase-shift.

30 Claims, 4 Drawing Sheets

1:N MEM SWITCH MODULE

BACKGROUND OF THE INVENTION

1. Field of the Invention

This invention relates to the field of micro-electromechanical (MEM) devices, and particularly to MEM switches and their applications.

2. Description of the Related Art

Many circuits require a multiplexing function, in which an incoming signal is selectably switched to one of N output terminals. This is commonly accomplished with electromechanical or solid-state switches—typically field-effect transistors (FETs)—which are closed as necessary to provide the desired signal path.

However, there are several problems related to the use of solid-state switches, particularly at very high frequencies. Integrated switches capable of handling such frequencies are typically implemented with gallium arsenide (GaAs) MESFETs or PIN diode circuits. At high signal frequencies (above about 900 MHz), these switching devices or circuits typically exhibit an insertion loss in the ON (closed) state of about 0.5 db. Additional gain must often be built into a system to compensate for the poor performance of the devices, increasing power dissipation, cost, and unit size and weight. The characteristics of GaAs MESFETs and PIN diode switches are discussed, for example, in R. Dorf, *The Electrical Engineering Handbook*, CRC Press (1993), pp. 1011–1013.

Providing switching with PIN diode circuits presents additional problems due to the parasitic capacitances inherently created by their use, which serve to limit the frequency range over which the circuit can operate. Similar problems arise when the necessary switching is provided by off-chip switches, due to the parasitic capacitances that result from the presence of wire bonds.

Another approach requires the use of micro-electromechanical (MEM) switches. MEM switches generally provide lower insertion losses than MESFETs or PIN diode circuits, and are particularly well-suited to use with very high frequency signals. MEM-based multiplexers might be used, for example, for switch matrices, component selection, signal routing, redundancy switching, or to implement a multi-bit phase shifter. An example of a 2-bit phase shifter circuit is shown in FIG. 1. An incoming signal is applied to an input terminal IN, and is switched to a 0° or 90° delay circuit via respective MEM switches 10 and 12 which form a 1:2 multiplexer 13. The outputs of the 0° and 90° delay circuits are provided at a node 14 via another 1:2 mux 15 comprising MEM switches 16 and 18, which are needed to isolate the signal path from unused transmission line sections. A mux 19 comprising MEM switches 20 and 22 switch node 14 to 0° or 180° delay circuits, respectively, the outputs of which are provided to an output terminal OUT via a mux 23 comprising MEM switches 24 and 26, respectively.

This approach can also prove troublesome, however. Switched signals can be subject to insertion losses due to inductance mismatch and signal reflection on the multiplexers' output lines. This is particularly bad for an application such as the 2-bit phase shifter shown in FIG. 1, in which an incoming signal must pass through four MEM switches before reaching the output terminal. Another drawback is that each multiplexer requires a considerable amount of die area.

SUMMARY OF THE INVENTION

A 1:N MEM switch module is presented which overcomes the problems noted above. Both the number of switches and the die area required are reduced when compared with conventional designs, while still providing low insertion loss and enabling operation at very high frequencies.

The module comprises N MEM switches fabricated on a common substrate. Each switch has an input contact and an output contact, and a movable contact which bridges the input and output contacts when the switch is actuated. A common signal input line on the substrate receives a signal to be switched. Each switch's input contact is connected to the common signal input line via a switch input line, and each output contact is connected to a respective signal output line. Each of the switch input lines has an associated inductance and effective capacitance, and each line is arranged such that its inductance is matched to its effective capacitance. This is done to reduce signal reflections which might arise due to the unterminated open stubs presented to the input signal by open switches; the inductance matching reduces reflections at the design frequency and thus the switch module's insertion loss. Matching is effected by, for example, using appropriately-sized open stub sections on the switch input lines in a manner to achieve equivalent performance for the different output paths.

The MEM switches are preferably located symmetrically about the terminus point of the common signal input line. This allows the switches to be tightly packed and the stub lengths to be kept small, which further reduces unwanted signal reflections. For example, a 1:4 MEM switch module preferably has four MEM switches arranged along four sides of a pentagon centered about the terminus point, with the common signal input line bisecting the fifth side of the pentagon en route to the terminus point. In this way, the die area required by the module is reduced. There may be applications, however, where different (non-symmetrical) configurations are preferred.

The present MEM switch module is suitably employed to provide a low-loss RF phase shifter. At least two switch modules form a phase shifter which includes N transmission lines having different lengths, with each transmission line connected at one end to a signal output line of a first switch module and at the other end to a signal output line of a second switch module. The modules are operated such that an RF input signal applied to the common signal input line of the first switch module is routed to the common signal input line of the second switch module via one of the transmission lines. In this way, the RF input signal is phase-shifted by a predetermined amount and passes through only two MEM switches.

Further features and advantages of the invention will be apparent to those skilled in the art from the following detailed description, taken together with the accompanying drawings.

DETAILED DESCRIPTION OF THE INVENTION

Figure 1:
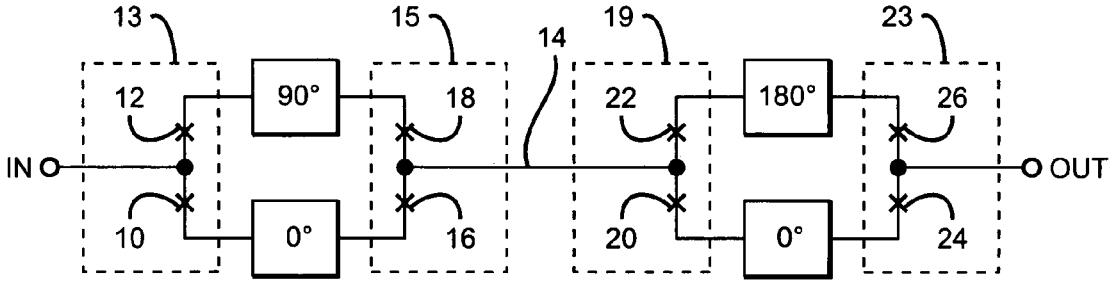
FIG. 1 PRIOR ART
FIG. 1 illustrates a known 1:2 MEM switching arrangement applied to a 2-bit phase shifter circuit.
Figure 2:
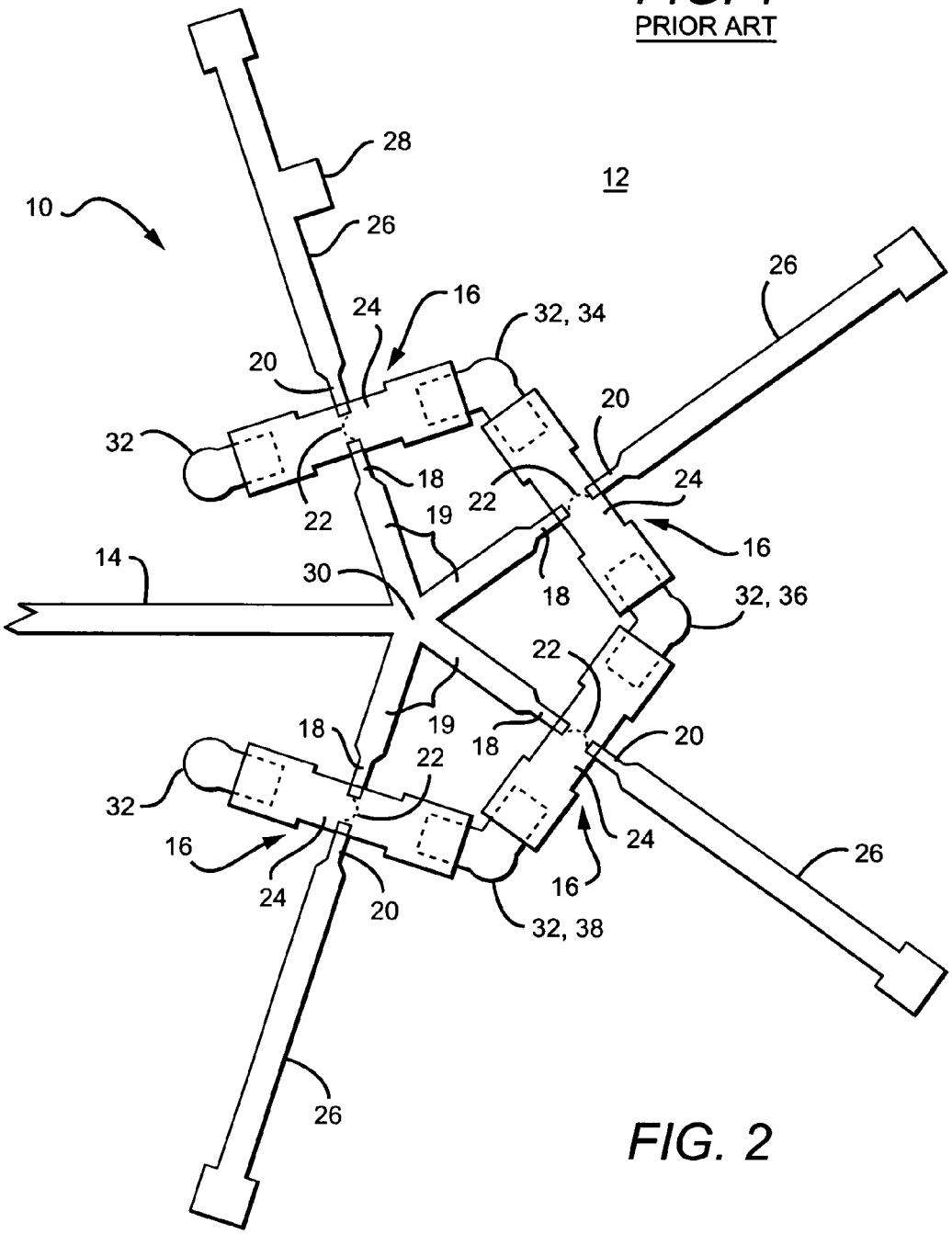
FIG. 2 is a plan view of a MEM 1:4 switch module in accordance with the present invention.

A plan view of a 1:N MEM switch module 10 in accordance with the present invention is shown in FIG. 2. The module's MEM switches and interconnecting traces are fabricated on a common substrate 12. The module comprises a common signal input line 14 which receives a signal to be switched, and N MEM switches 16; in the example shown, there are four MEM switches.

Each MEM switch in the module has an input contact 18 and an output contact 20 on substrate 12, with the two contacts separated by a gap 22. Each switch also includes a movable contact 24 which provides an electrically continuous path between the switch's input and output contacts when the switch is "actuated". Each input contact 18 is connected to common signal input line 14 via a switch input line 19, and each output contact 20 is connected to a respective signal output line 26. While the MEM devices in this example are ohmic-contact switches which provide a conductive path upon closure, the invention can also be implemented using capacitive switches which couple the signal through a thin insulator layer upon closure.

A MEM switch is "actuated" when an appropriate stimulus is provided. For example, for an electrostatically-actuated MEM switch, a drive voltage is applied between movable contact 24 and a conductive trace on the substrate 12 below the contact. The drive voltage creates an electrostatic force which attracts contact 24 toward the substrate, thereby bridging gap 22 and providing a conductive path between the switch's input and output contacts. A number of other switch actuation techniques are known, including thermal, piezoelectric, electromagnetic, gas bubble, Lorentz force, surface tension, or combinations of these; other actuation techniques may be known to those skilled in the art. The present invention may employ MEM switches operated by any of these methods.

In operation, an input signal is applied to common signal input line 14, and one of the N MEM switches is closed to route the applied signal to a desired one of the signal output lines. The other MEM switches are left open, to isolate the signal path from unused signal output lines.

Each of switch input lines 19 has an associated effective capacitance. An element of the invention is that each switch input line be designed such that its inductance is matched to its effective capacitance at a given design frequency. If unmatched, the capacitances associated with the switch input lines of open switches can cause signal reflections which increase the switches' insertion loss and degrade signal quality. Matching each switch input line's inductance to its effective capacitance at a given design frequency has the effect of minimizing such reflections.

If necessary to achieve an additional degree of signal reflection reduction, open stub sections can be employed on the signal output lines as well, to effect the matching of each output line's inductance to its effective capacitance; an example of such an open stub 28 is shown in FIG. 2.

Many inductance matching techniques are known to those familiar with the field, including the afore-mentioned open stubs, adjusting the width, length, and/or thickness of the line, and chamfering 90-degree bends. Additional guidance can be found, for example, in "A DC-to-40 GHz Four-Bit RF MEMS True-Time Delay Network", Kim et al., IEEE Microwave and Wireless Components Lett., vol. 11, pp. 56–58, February 2001.

The MEM switches are preferably positioned symmetrically about the "terminus point" of common signal input line 14; i.e., the end of the common signal input line nearest the MEM switches. In FIG. 2, the common signal input line has a terminus point 30. Each of switch input lines 19 is preferably connected to common signal input line 14 at terminus point 30, and all N of the MEM switches are arranged symmetrically about terminal point 30. This "star" configuration is preferred because it tends to reduce the length of the switch input lines, which act as unterminated open stubs when their respective switches are open. Reducing the length of the stubs tends to reduce signal reflections and conductor-related losses. The symmetrical arrangement of switches also tends to provide an compact and highly efficient arrangement, which requires uses less die area than prior art designs.

This symmetry is illustrated in FIG. 2. Here, N=4, and the four MEM switches are arranged symmetrically along four sides of a pentagon centered about terminus point 30. Common signal input line 14 bisects the fifth side of the pentagon en route to terminus point 30.

As noted above, a typical MEM switch is actuated by applying a drive voltage between movable contact 24 and a conductive trace on the substrate below the contact. Those conductive traces are frequently routed to one or more other metallization layers on the chip using vias 32. Further space efficiencies can be realized by arranging the vias symmetrically about terminus point 30, and having at least some of the vias (34, 36, 38) shared by adjacent MEM switches.

When so arranged, a 1:N MEM switch module is provided which is capable of operating at very high frequencies, with low insertion and reflection losses, and which occupies a relatively small die area.

A switch module in accordance with the present invention may include more or less than 4 MEM switches, and still achieve the preferred symmetry. For example, a module could include 6 MEM switches arranged symmetrically around the signal input line's terminus point so as to form a heptagon, with one of the heptagon's sides bisected by the common signal input line. Similarly, the module's vias could be arranged symmetrically about the terminus point and thus shared by adjacent MEM switches.

As noted above, MEM switches are implemented in numerous ways which are well-known to those familiar with MEM device design. MEM switches as described herein are discussed, for example, in Yao and Chang, "A Surface Micromachined Miniature Switch for Telecommunications Applications with Signal Frequencies from DC up to 4 GHz," In Tech. Digest (1995), pp. 384–387, and in U.S. Pat. No. 5,578,976 to Yao, which is assigned to the same assignee as the present application, as well as in G. Rebeiz, "*RF MEMS Theory, Design, and Technology*," J. Wiley (June, 2002).

The substrate 12 upon which the present switch module is fabricated is preferably thicker than what would typically be used for transistor switches fabricated in a microstrip circuit configuration; i.e., the substrate is preferably optimized for use with the module's MEM switches. A substrate having a thickness of 5–10 mils and comprising GaAs or indium phosphide (InP) is preferred, as such substrates can be made very flat and are microwave compatible. These thicker substrates enable use of wider transmission lines, reducing the insertion loss of the circuit as a whole. Other substrates, such as high-resistivity silicon, microwave-compatible ceramics such as $Al_2O_3$ or quartz, and others compatible with RF applications may also be used.

A typical MEM switch is actuated via the application of a drive voltage to its movable contact. If necessary, such drive voltages can be routed to the movable contacts using air bridges which traverse signal lines or traces on the substrate.

Figure 3:
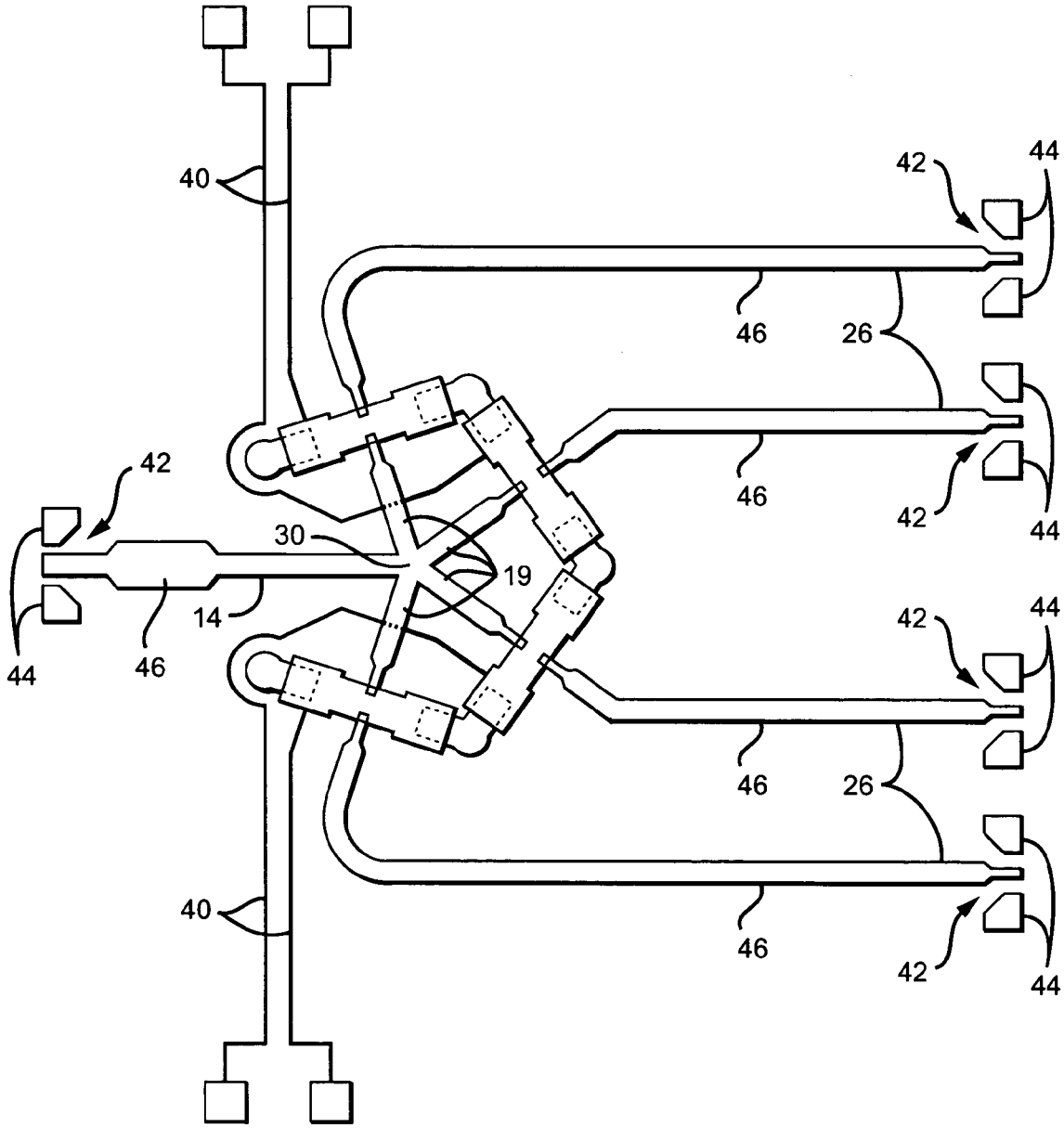
FIG. 3 is a plan view of another embodiment of a MEM 1:4 switch module in accordance with the present invention.

One possible application of the present switch module is shown in FIG. 3, which depicts a 1:4 MEM switch module with the common signal input line 14 approaching the module on one side, and all the signal output lines 26 routed away from the module on the opposite side. This arrangement facilitates interconnections and packaging, and allows switch drive signals 40 (shown in simplified form) to be routed from above and below the module. This embodiment also includes co-planar waveguide (CPW) to microstrip transitions 42: the signal input and signal output lines are partly CPWs, in which there are ground lines 44 on either side of each signal line. These signal lines transition to microstrips 46 near the switch module.

Many other applications are envisioned for the present switch module, including switch matrices, component selection, signal routing, and redundancy switching.

The present MEM switch module may also be suitably employed in a novel phase shifter application. A MEM switch-based phase shifter could have many applications; for example, as a component of an electronically-scanned antenna, with the phase shift applied to an RF input signal affecting the direction of the antenna beam. As noted above, prior art phase shifters can exhibit unacceptable losses between input and output, or require too much area. The present invention overcomes these problems, as discussed below.

Figure 4:
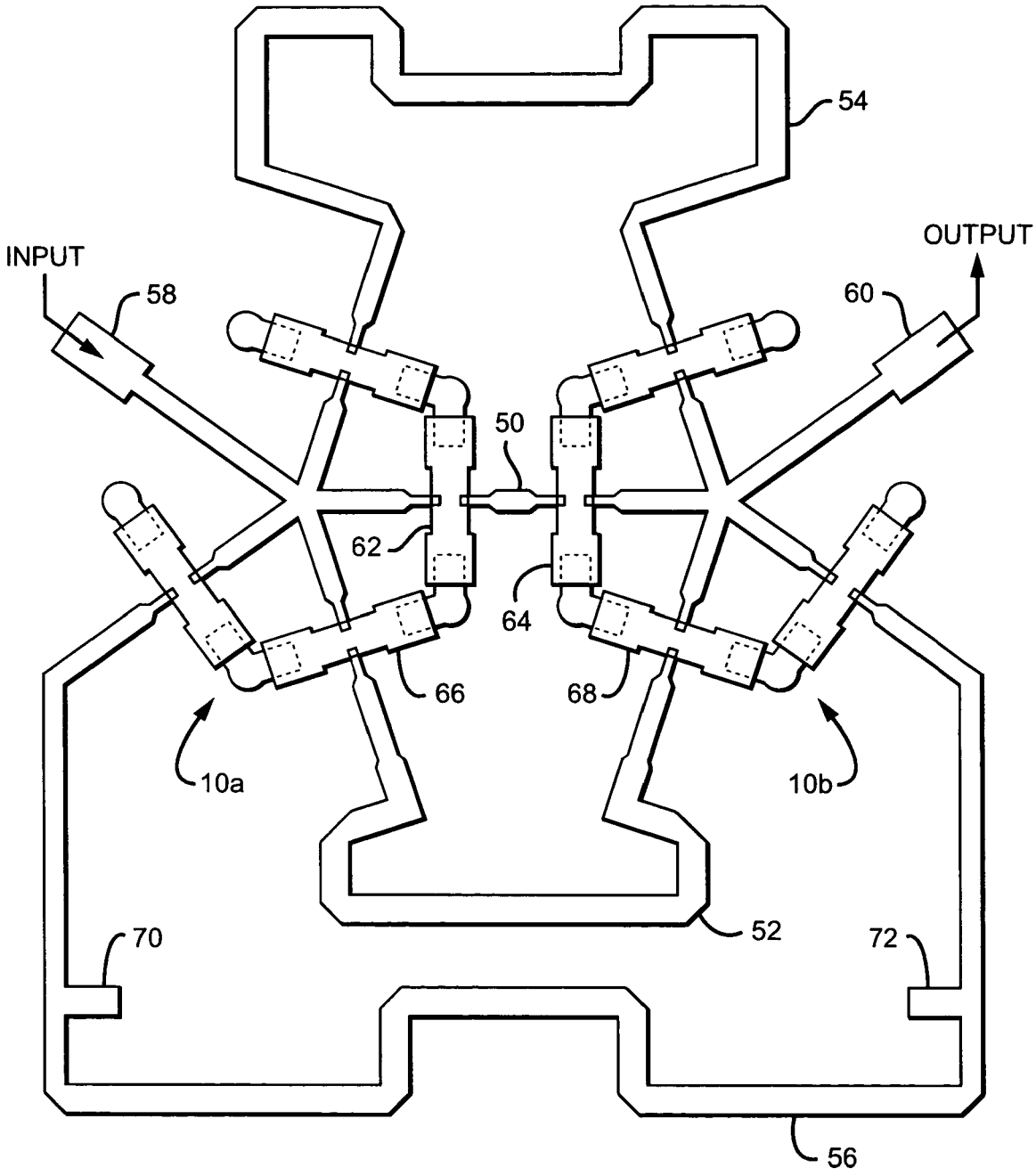
FIG. 4 is a plan view of a MEM phase shifter in accordance with the present invention.

As shown in the exemplary embodiment shown in FIG. 4, a MEM phase shifter includes at least two MEM switch modules. The modules are connected together with N transmission lines having different lengths; in FIG. 4, two 1:4 MEM switch modules 10*a*, 10*b* are connected together with four transmission lines 50, 52, 54, 56. Each transmission line is connected at one end to one of the signal output lines of switch module 10*a*, and at its other end to one of the signal output lines of switch module 10*b*. The common signal input line 58 of one of the modules serves as the phase shifter's input, and the common signal input line 60 of the other module serves as the phase shifter's output. An RF input signal to be phase-shifted is applied to input line 58. The switch modules are operated such that the RF input signal is routed to phase shifter output 60 via one of the transmission lines. For example, if the RF input signal is to be phase-shifted via transmission line 50, MEM switch 62 on module 10*a* and MEM switch 64 on module 10*b* are closed; to select transmission line 52, switches 66 and 68 are selected, and so forth. Because the transmission lines have different lengths, the RF input signal will be phase-shifted by different amounts depending on the route selected. Note that the RF input signal to be phase-shifted might alternatively be applied to line 60 and routed via switch modules 10*b* and 10*a* to line 58.

For example, the length of transmission line 50 might be selected to provide a relative phase shift of 0°, with transmission lines 52, 54 and 56 selected to provide relative phase shifts of 90°, 180°, and 270°, respectively. The transmission lines can be selected to provide selectable phase shifts as required by a particular application.

If more than four phase shifts are required, a switch module having an N greater than 4 could be employed. For example, if an application requires the ability to select from among 6 different phase shift values, two 1:6 MEM switch modules per the present invention could be employed.

The present phase shifter requires the RF input signal to pass through only two MEM switches (one switch per module), thereby reducing switch losses that can arise in prior art designs which require the input signal to pass through four or more switches. As noted above, conductive losses can be reduced with the use of a thicker substrate which has been optimized for MEM devices, as discussed above. The size of the phase shifter is also reduced in comparison to prior art designs, by virtue of the compact design of the present MEM 1:N switch module.

As above, each switch input line can be designed such that its inductance is matched to its effective capacitance at a given design frequency. The transmission lines can include inductive matching stubs such as stubs 70, 72 to effect the matching of each line's inductance to its effective capacitance at the design frequency, in order to reduce signal reflection as discussed above.

Figure 5:
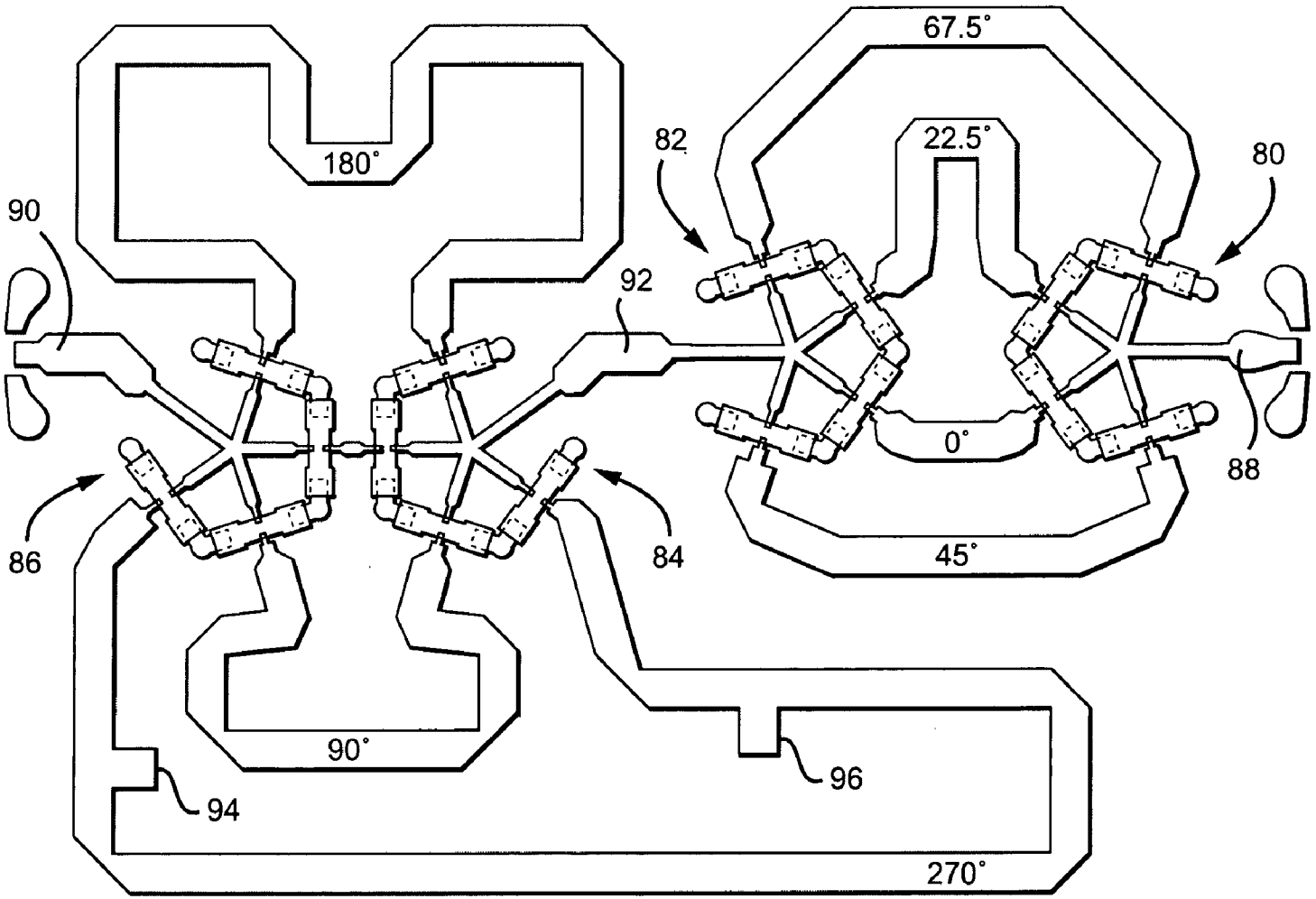
FIG. 5 is another embodiment of a MEM phase shifter in accordance with the present invention.

Another possible MEM phase-shifter embodiment is shown in FIG. 5. Here, a serial implementation of N-bit phase-shifter modules is used to increase the number of phase states available. In this example, four MEM 1:4 switch modules 80, 82, 84, 86 are used to provide a total of seven selectable phase shift values (switch drive signal paths not shown for clarity). The common signal input line 88 of switch module 80 provides the phase-shifter's input, and the common signal input line 90 of switch module 86 provide the phase-shifter's output. Switch modules 80 and 82 are interconnected with four transmission lines to form a first phase shifter which provides relative phase-shifts of, for example, 0°, 22.5°, 45°, and 67.5°. The signal input line 92 of switch module 82 provide the output of this first phase shifter. Switch modules 84 and 86 are also interconnected with four transmission lines to form a second phase shifter, with the signal input line 92 of switch module 84 connected to the output of the first phase shifter such that the first and second phase shifters are connected in series. The second phase shifter adds relative phase-shifts of 90°, 180°, and 270°.

An RF input signal to be phase-shifted is applied to input line 88. The switch modules are operated such that the RF input signal is routed to phase shifter output 90 via two of the transmission lines. For example, if the RF input signal is to be phase-shifted by 270°, one switch in each of modules 80 and 82 is closed to route the RF input signal to output 92 via the 0° transmission line, and one switch in each of modules 84 and 86 is closed to route the RF input signal to output 90 via the 270° transmission line. Of course, the lengths of the transmission lines can be adjusted as necessary to provide a desired selection of phase-shift values.

In this way, a phase shifter can offer more than four selectable phase-shifts using 1:4 MEM switches as described herein, all in a relatively small area and with low losses. This approach can be adapted as needed to provide a number of selectable phase-shifts in the values required for a particular application.

As above, each switch input line be designed such that its inductance is matched to its effective capacitance at a given design frequency, and the transmission lines can include inductive matching stubs such as stubs 94, 96 to effect the matching of each line's inductance to its effective capacitance at the design frequency, to reduce signal reflection.

More than four MEM switch modules might be employed to provide more selectable phase-shift values. MEM switch modules having N>4 might also be used to provide a greater number of phase-shift values. Though the switch modules preferably have their switches arranged symmetrically about a central terminus point, this is not essential to the invention, and a non-symmetrical arrangement may be preferred in some instances.

While particular embodiments of the invention have been shown and described, numerous variations and alternate embodiments will occur to those skilled in the art. Accordingly, it is intended that the invention be limited only in terms of the appended claims.

We claim:

1. A 1:N micro-electromechanical (MEM) switch module, comprising:

a substrate, a signal input line on said substrate for receiving a signal to be switched, and N MEM switches on said substrate, each of said switches having an input contact and an output contact on said substrate which are separated by a gap, and a movable contact which provides an electrically continuous signal path between said input and output contacts when said switch is actuated, each of said input contacts connected to said signal input line via respective switch input lines and each of said output contacts connected to respective signal output lines, wherein each of said switch input lines has an associated effective capacitance, said switch input lines designed such that the inductance of each switch input line is matched to its effective capacitance at a given design frequency such that the impedance of each of said input lines is largely resistive at said design frequency.

2. The switch module of claim 1, wherein at least one of said signal output lines includes one or more open stub sections which effect the matching of said signal output lines s inductance to its effective capacitance.

3. The switch module of claim 1, wherein said signal input line has a terminus point and each of said switch input lines is connected to said signal input line at said terminus point, all N of said MEM switches arranged such that they are rotationally symmetric about said terminus point.

4. The switch module of claim 3, wherein N=4 and said MEM switches are arranged along four sides of a pentagon centered about said terminus point, said signal input line bisecting the fifth side of said pentagon en route to said terminus point.

5. The switch module of claim 1, wherein each of said MEM switches is an ohmic-contact switch which provides a conductive path upon closure.

6. The switch module of claim 1, wherein each of said MEM switches is a capacitive switch which couples an applied signal between said input and output contacts through a thin insulator layer upon closure.

7. The switch module of claim 1, wherein each of said MEM switches is electrostatically-actuated with a respective drive voltage applied between said movable contact and at least one corresponding trace on said substrate.

8. The switch module of claim 7, wherein said drive voltages are applied to at least some of said movable contacts using air bridges which traverse signal lines or traces on said substrate.

9. The switch module of claim 1, wherein each of said MEM switches is thermally-actuated.

10. The switch module of claim 1, wherein each of said MEM switches is piezoelectrically-actuated.

11. The switch module of claim 1, wherein each of said MEM switches is actuated with a respective drive voltage applied between said movable contact and at least one corresponding trace on said substrate, each of said corresponding traces connected to a via, said vias arranged symmetrically about said terminus point such that at least some of said vias are shared by adjacent ones of said MEM switches.

12. The switch module of claim 1, wherein the thickness of said substrate is 5–10 mils.

13. The switch module of claim 1, wherein said substrate comprises gallium arsenide (GaAs).

14. The switch module of claim 1, wherein said substrate comprises indium phosphide (InP).

15. The switch module of claim 1, wherein said substrate comprises silicon.

16. The switch module of claim 1, wherein said substrate comprises microwave-compatible ceramics.

17. The switch module of claim 2, wherein first and second ones of said MEM switch modules form a phase shifter which includes N transmission lines having different lengths, each of said transmission lines connected at one end to a respective one of the signal output lines of said first switch module and at the other end to a respective one of the signal output lines of said second switch module, said switch modules operated such that an input signal applied to the signal input line of one of said switch modules is routed to the signal input line of the other of said switch modules via one of said transmission lines such that said input signal passes through two of said MEM switches.

18. The switch module of claim 17, wherein N=4, said phase shifter is a 2-bit phase shifter, and said four transmission lines are arranged to provide relative phase shifts of approximately 0°, 90°, 180° and 270°, respectively, to said input signal.

19. The switch module of claim 17, wherein at least two of said phase shifters are cascaded to provide a greater number of distinct phase states.

20. A 1:4 micro-electromechanical (MEM) switch module, comprising:

a substrate, a signal input line on said substrate for receiving a signal to be switched, said signal input line having a terminus point, and four MEM switches on said substrate, each of said switches having an input contact and an output contact on said substrate which are separated by a gap, and a movable contact which provides an electrically continuous signal path between said input and output contacts when said switch is actuated, each of said input contacts connected to said signal input line at said terminus point via respective switch input lines and each of said output contacts connected to respective signal output lines, said MEM switches arranged along four sides of a pentagon centered about said terminus point, said signal input line bisecting the fifth side of said pentagon en route to said terminus point, each of said MEM switches actuated with a respective drive voltage applied between said movable contact and at least one corresponding trace on said substrate, each of said corresponding traces connected to a via, said vias arranged symmetrically about said terminus point such that at least some of said vias are shared by adjacent ones of said MEM switches, each of said switch input lines having an associated effective capacitance, said switch input lines designed such that the inductance of each switch input line is matched to its effective capacitance at a given design frequency such that the impedance of each of said input lines is largely resistive at said design frequency.

21. An RF micro-electromechanical (MEM) phase shifter, comprising:

at least two 1:N micro-electromechanical (MEM) switch modules, each of which comprises:

a substrate, a signal input line on said substrate for receiving a signal to be switched, and N MEM switches on said substrate, each of said switches having an input contact and an output contact on said substrate which are separated by a gap, and a movable contact which provides an electrically continuous signal path between said input and output contacts when said switch is actuated, each of said input contacts connected to said signal input line via respective switch input lines and each of said output contacts connected to respective signal output lines, each of said switch input lines having an associated effective capacitance, said switch input lines arranged such that the inductance of each switch input line is matched to its effective capacitance at a given design frequency such that the impedance of each of said input lines is largely resistive at said design frequency, N transmission lines having different lengths, each of said transmission lines connected at one end to a respective one of the signal output lines of a first switch module and at the other end to a respective one of the signal output lines of a second switch module, said switch modules operated such that an input signal applied to the signal input line of one of said switch modules is routed to the signal input line of another of said switch modules via one of said transmission lines such that said input signal is phase-shifted by predetermined amount and passes through two of said MEM switches.

22. The phase shifter of claim 21, wherein said phase shifter is a 2-bit phase shifter comprising two switch modules having four MEM switches each, and said four transmission lines provide relative phase shifts of approximately 0°, 90°, 180° and 270°, respectively, to said input signal.

23. The phase shifter of claim 21, wherein at least one of said signal output lines and/or transmission lines includes one or more open stub sections which effect the matching of said signal output line's inductance to its effective capacitance.

24. The phase shifter of claim 21, wherein, for each of said switch modules, said signal input line has a respective terminus point and each of said input contacts is connected to said signal input line at said terminus point via respective ones of said switch input lines, all N of said MEM switches arranged symmetrically about said terminus point.

25. The phase shifter of claim 24, wherein N=4 and the MEM switches of each switch module are arranged along four sides of a pentagon centered about said module's terminus point, said signal input line bisecting the fifth side of said pentagon en route to said terminus point.

26. The phase shifter of claim 21, wherein each MEM switch of each switch module is actuated with a respective drive voltage applied between its movable contact and at least one corresponding trace on said substrate, each of said corresponding traces connected to a via, said vias arranged symmetrically about said module's terminus point such that at least some of said vias are shared by adjacent ones of said MEN switches.

27. An RE micro-electromechanical (MEM) phase shifter comprising first and second 1:4 MEM switch modules, each of said switch modules comprising:

a substrate, a signal input line on said substrate for receiving a signal to be switched, said signal input line having a terminus point, and four MEM switches on said substrate, each of said switches having an input contact and an output contact on said substrate which are separated by a gap, and a movable contact which provides an electrically continuous signal path between said input and output contacts when said switch is actuated, each of said input contacts connected to said signal input line at said terminus point via respective switch input lines and each of said output contacts connected to respective signal output lines, said MEM switches arranged along four sides of a pentagon centered about said terminus point, said signal input line bisecting the fifth side of said pentagon en route to said terminus point, each of said MEM switches actuated with a respective drive voltage applied between said movable contact and at least one corresponding trace on said substrate, each of said corresponding traces connected to a via, said vias arranged symmetrically about said terminus point such that at least some of said vias are shared by adjacent ones of said MEM switches, each of said switch input lines having an associated effective capacitance, said switch input lines arranged such that the inductance of each switch input line is matched to its effective capacitance at a given design frequency such that the impedance of each of said input lines is largely resistive at said design frequency, and four transmission lines having different lengths, each of said transmission lines connected at one end to a respective one of the signal output lines of said first switch module and at the other end to a respective one of the signal output lines of said second switch module, said switch modules operated such that an input signal applied to the signal input line of one of said switch modules is routed to the signal input line of the other of said switch modules via one of said transmission lines such that said input signal is phase-shifted by predetermined amount and passes through two of said MEM switches.

28. The phase shifter of claim 27, further comprising additional ones of said 1:4 switch modules interconnected with said first and second switch modules such that additional transmission lines having lengths different from said four transmission lines are provided between first and second ones of said signal input lines.

29. A 1:4 micro-electromechanical (MEM) switch module, comprising:

a substrate, a signal input line on said substrate for receiving a signal to be switched, said signal input line having a terminus point, and four MEM switches on said substrate, each of said switches having an input contact and an output contact on said substrate which are separated by a gap, and a movable contact which provides an electrically continuous signal path between said input and output contacts when said switch is actuated, each of said input contacts connected to said signal input line at said terminus point via respective switch input lines and each of said output contacts connected to respective signal output lines, said MEM switches arranged along four sides of a pentagon centered about said terminus point, said signal input line bisecting the fifth side of said pentagon en route to said terminus point, said signal output lines routed away from said module on the side of said module opposite said fifth side, to facilitate the interconnection of said signal output lines, each of said MEM switches actuated with a respective drive voltage applied between said movable contact and at least one corresponding trace on said substrate, each of said corresponding traces connected to a via, said vias arranged symmetrically about said terminus point such that at least some of said vias are shared by adjacent ones of said MEM switches, each of said switch input lines having an associated effective capacitance, said switch input lines designed such that the inductance of each switch input line is matched to its effective capacitance at a given such that the impedance of each of said input lines is largely resistive at said design frequency.

30. The switch module of claim 29, wherein said signal input line and signal output lines are co-planar waveguides which transition to respective microstrips near said module.

* * * * *

UNITED STATES PATENT AND TRADEMARK OFFICE

CERTIFICATE OF CORRECTION

PATENT NO. : 7,157,993 B2
APPLICATION NO. : 10/676875
DATED : January 2, 2007
INVENTOR(S) : Jeffrey F. DeNatale et al.

It is certified that error appears in the above-identified patent and that said Letters Patent is hereby corrected as shown below:

Claim 4 is cancelled.

Claim 20 is cancelled.

Claim 25 is cancelled.

Column 9 claim 26, line 67, change “MEN switches.” to --MEM switches.--

Column 10 claim 27, line 1, change “RE” to --RF--

Claim 27 is amended to read as follows:

An RF micro-electromechanical (MEM) phase shifter comprising first and second 1:4 MEM switch modules, each of said switch modules comprising:

a substrate, a signal input line on said substrate for receiving a signal to be switched, said signal input line having a terminus point, and four MEM switches on said substrate, each of said switches having an input contact and an output contact on said substrate which are separated by a gap, and a movable contact which provides an electrically continuous signal path between said input and output output contacts when said switch is actuated, each of said input contacts connected to said signal input line at said terminus point via respective switch input lines and each of said output contacts connected to respective signal output lines, each of said MEM switches actuated with a respective drive voltage applied between said movable contact and at least one corresponding trace on said substrate, each of said corresponding traces connected to a via, said vias arranged symmetrically about said terminus point such that at least some of said vias are shared by adjacent ones of said MEM switches.

each of said switch input lines having an associated effective capacitance, said switch input lines arranged such that the inductance of each switch input line is matched to its effective capacitance at a given design frequency such that the impendance of each of said input lines is largely resistive at said design frequency, and

UNITED STATES PATENT AND TRADEMARK OFFICE

CERTIFICATE OF CORRECTION

PATENT NO. : 7,157,993 B2
APPLICATION NO. : 10/676875
DATED : January 2, 2007
INVENTOR(S) : Jeffrey F. DeNatale et al.

It is certified that error appears in the above-identified patent and that said Letters Patent is hereby corrected as shown below:

four transmission lines having different lengths, each of said transmission lines connected at one end to a respective one of the signal output lines of said first switch module and at the other end to a respective one of the signal output lines of said second switch module, said switch modules operated such that an input signal applied to the signal input line of one of said switch modules is routed to the signal input line of the other of said switch modules via one of said transmission lines such that said input signal is phase-shifted by predetermined amount and passes through two of said MEM switches.

Column 12 claim 29, line 7, replace “at a given such that” with --at a given design frequency such that--

Claim 29 is amended to read as follows:

A 1:4 micro-electromechanical (MEM) switch module, comprising:

a substrate, a signal input line on said substrate for receiving a signal to be switched, said signal input line having a terminus point, and four MEM switches on said substrate, each of said switches having an input contact and an output contact on said substrate which are separated by a gap, and a movable contact which provides an electrically continuous signal path between said input and output contacts when said switch is actuated, each of said input contacts connected to said signal input line at said terminus point via respective switch input lines and each of said output contacts connected to respective signal output lines, said signal output lines routed away from said module on the side of said module opposite said fifth side, to facilitate the interconnection of said signal output lines, each of said MEM switches actuated with a respective drive voltage applied between said movable contact and at least one corresponding trace on said substrate, each of said corresponding traces connected to a via, said vias arranged symmetrically about said terminus point such that at least some of said vias are shared by adjacent ones of said MEM switches,

UNITED STATES PATENT AND TRADEMARK OFFICE

CERTIFICATE OF CORRECTION

PATENT NO. : 7,157,993 B2
APPLICATION NO. : 10/676875
DATED : January 2, 2007
INVENTOR(S) : Jeffrey F. DeNatale et al.

It is certified that error appears in the above-identified patent and that said Letters Patent is hereby corrected as shown below:

each of said switch input lines having an associated effective capacitance, said switch input lines designed such that the inductance of each switch input line is matched to its effective capacitance at a given design frequency such that the impendance of each of said input lines is largely resistive at said design frequency.

Signed and Sealed this

Nineteenth Day of February, 2008

JON W. DUDAS
*Director of the United States Patent and Trademark Office*